United States Patent [19]

Genevray

[11] Patent Number: 5,016,431

[45] Date of Patent: May 21, 1991

[54] THREAD DEFLECTORS, PARTICULARLY FOR A HOLLOW SPINDLE MACHINE

[75] Inventor: Henri Genevray, Guebwiller, France

[73] Assignee: N. Schlumberger Et Cie, S.A., Guebwiller, France

[21] Appl. No.: 376,606

[22] Filed: Jul. 7, 1989

[30] Foreign Application Priority Data

Jul. 12, 1988 [FR] France ..... 88 09657

[51] Int. Cl.[5] ..... D02G 03/36

[52] U.S. Cl. ..... 57/19; 57/18

[58] Field of Search ..... 57/16–19, 57/261, 263

[56] References Cited

U.S. PATENT DOCUMENTS

| | | | |
|---|---|---|---|
| 4,228,639 | 10/1980 | Hunt et al. | 57/16 |
| 4,318,269 | 3/1982 | Egbers et al. | 57/18 |
| 4,574,574 | 3/1986 | Knaak | 57/19 |
| 4,605,182 | 8/1986 | Zollinger | 57/18 X |
| 4,672,801 | 6/1987 | Abduganiev | 57/19 X |

FOREIGN PATENT DOCUMENTS

| | | |
|---|---|---|
| 58-70719 | 4/1983 | Japan . |
| 60-67366 | 4/1985 | Japan . |
| 1603717 | 11/1981 | United Kingdom . |

*Primary Examiner*—Stuart S. Levy
*Assistant Examiner*—Steven M. duBois
*Attorney, Agent, or Firm*—Young & Thompson

[57] ABSTRACT

Deflection members for threads, particularly for a hollow spindle machine. The members are movable in translation by a displacement device, from a first position, during normal functioning of the machine, in which each thread (2) is no longer in contact with the corresponding deflection member, and thus with the corresponding twisting device (3), to a second position during the phases of acceleration, deceleration and stoppage of the machine, in which each thread (2) is then applied by the deflection member (1) with which it is in contact, against the corresponding twisting device (3). The thread thus receives during only these three phases, the false tension necessary to impart to it at that time constant tension and winding independent of the speed of thread travel.

7 Claims, 3 Drawing Sheets

THREAD DEFLECTORS, PARTICULARLY FOR A HOLLOW SPINDLE MACHINE

The present invention relates to the field of thread deflectors, each associated respectively with a device for twisting the thread on itself, particularly for a hollow spindle machine such as a winding machine.

Such machines are especially characterized by various winding modules, disposed in parallel, and each comprised by cylinders delivering the thread which passes first through a conduit and then the interior of a hollow spindle where it receives the filament which is wound about it, thereby to constitute the wound thread, which is to say the product leaving the winding machine.

At present, these machines are provided also with false torsion devices, also called "rotafils", ensuring constant tension and winding no matter what the speed of the thread. These "rotafils" are each mounted at the outlet of each hollow spindle, and the thread is maintained continuously against the internal surface of each "rotafil" by a deflector member, for example a roller or the like. Each "rotafil" therefore has an internal surface whose shape and material permits causing the thread to twist on itself. This "rotafil" is for example of polyurethane elastomer or else of a metal covered with a granular surface of the electroerosion type or even covered striations identical to those on the rotor outlets of open-end thread handling devices.

The presence of such a "rotafil" is also indispensable to effect the so-called American connection, which is a raising of the thread from the wound bobbin to behind the pressure boss of the drawing cylinder. Thus this "rotafil" greatly favors the amalgamation of the drawn fibers and the linked thread. By temporarily actuating the rod which presses the thread against the "rotafil" there is obtained with precision an effect favoring the connection.

But said false torsion devices, also called "rotafils", have the drawback on the one hand of wearing very rapidly, particularly on their internal surfaces, which requires very frequent replacement and, on the other hand, of chafing the thread and of mishandling the filament, which can even result in a complete blocking of the spindle when, as is almost always the case, they are disposed downstream of this latter.

However, it has been discovered that this false torsion is necessary only during the three phases of acceleration, deceleration and stoppage of the machine. On the other hand, during normal operation of the machine such a false torsion applied to each thread is quite useless.

The general problem to be solved by the present invention is accordingly to conceive a device permitting use of each "rotafil" only during the three phases of acceleration, deceleration and stoppage of the machine, that is, applying the thread only temporarily against the internal surface of each "rotafil", in general mounted at the outlet of the spindle. Thus, the life of each "rotafil" will be considerably prolonged. Moreover, the thread will no longer be chafed and the filament will no longer be mishandled, which will avoid all the danger of blocking the spindle.

To this end, the present invention provides thread deflector members, one for each device for twisting the thread on itself, particularly for a hollow spindle machine such as a winding machine, members characterized in that they are movable in translation or rotation by displacement means, from a first position, during normal functioning of the machine, in which each thread is no longer in contact with the corresponding deflector member, and thus with the corresponding twisting device, to a second position during the phases of acceleration, deceleration and stoppage of the machine, in which each thread is then applied by the deflector member with which it is in contact, against the corresponding twisting device, so as to receive only during those three phases the false tension necessary to ensure to it, at that time, constant tension and winding independently of the speed of thread feed.

The invention will be better understood from the following description which relates to a preferred embodiment, given by way of non-limiting example, and explained with reference to the accompanying schematic drawings, in which.

Figure 1:
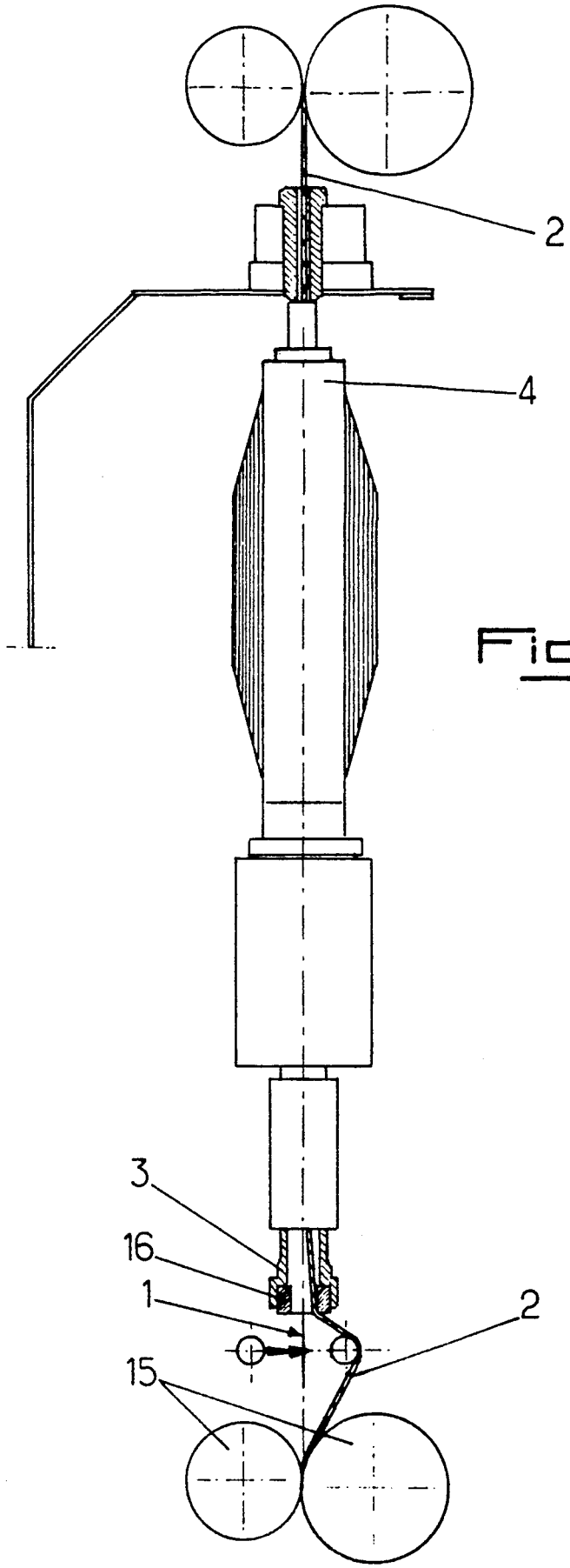
FIG. 1 is an elevational and cross-sectional view of a winding module provided, directly below the "rotafil", with movable translatory deflection members in the form of cylinders, accord to the invention.

According to the invention, the deflection members 1 are movable in translation or in rotation by displacement means 5, from a first position 6, during normal functioning of the machine, in which each thread 2 is no longer in contact with the corresponding deflection member 1, and thus with the corresponding twisting device 3, to a second position 7 during the phases of acceleration, deceleration and stoppage of the machine, in which each thread 2 is then applied by the deflection member 1 with which it is in contact, against the corresponding twisting device 3, so as to receive during only these three phases, the false tension necessary to ensure to it, at that moment, a constant tension and winding independent of the speed of thread travel (FIG. 1).

According to a first embodiment of the invention, the displacement means 5 are in the form of a connecting device 8 interconnecting all the deflection members 1, controlled by actuating means 9 and by electronic monitor 12.

Figure 2:
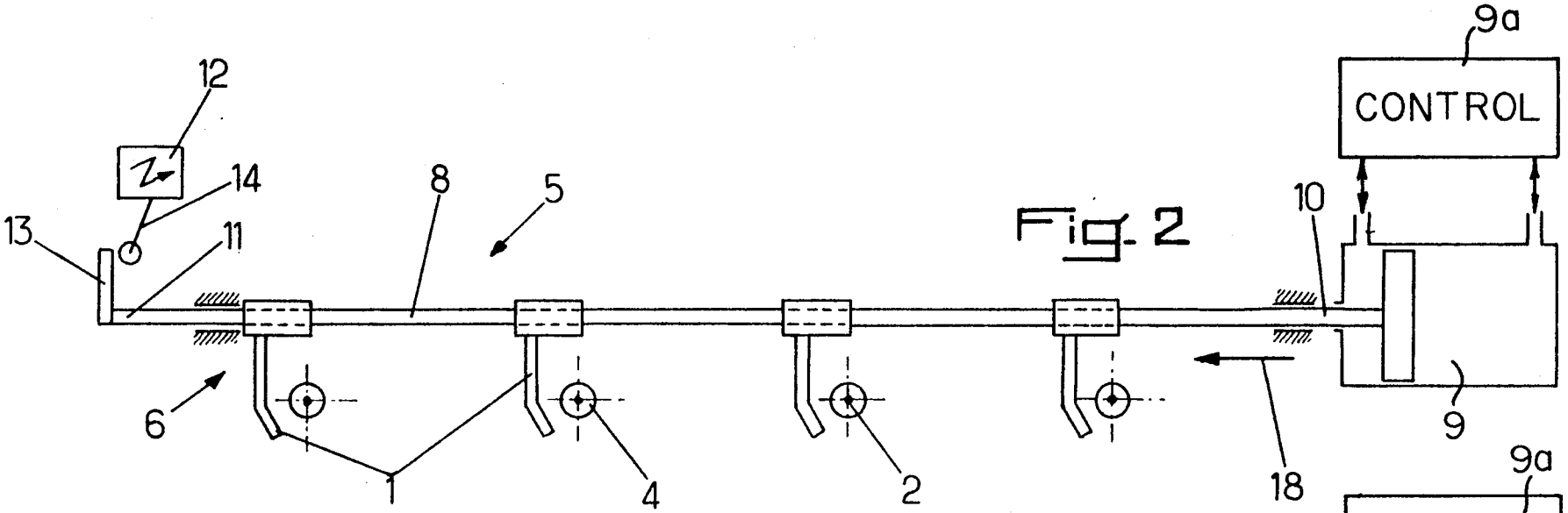
FIG. 2 is a plan view, on a different scale, of displacement means for the deflection members in the form of hooks, according to the invention, during normal operation of the machine.
Figure 3:
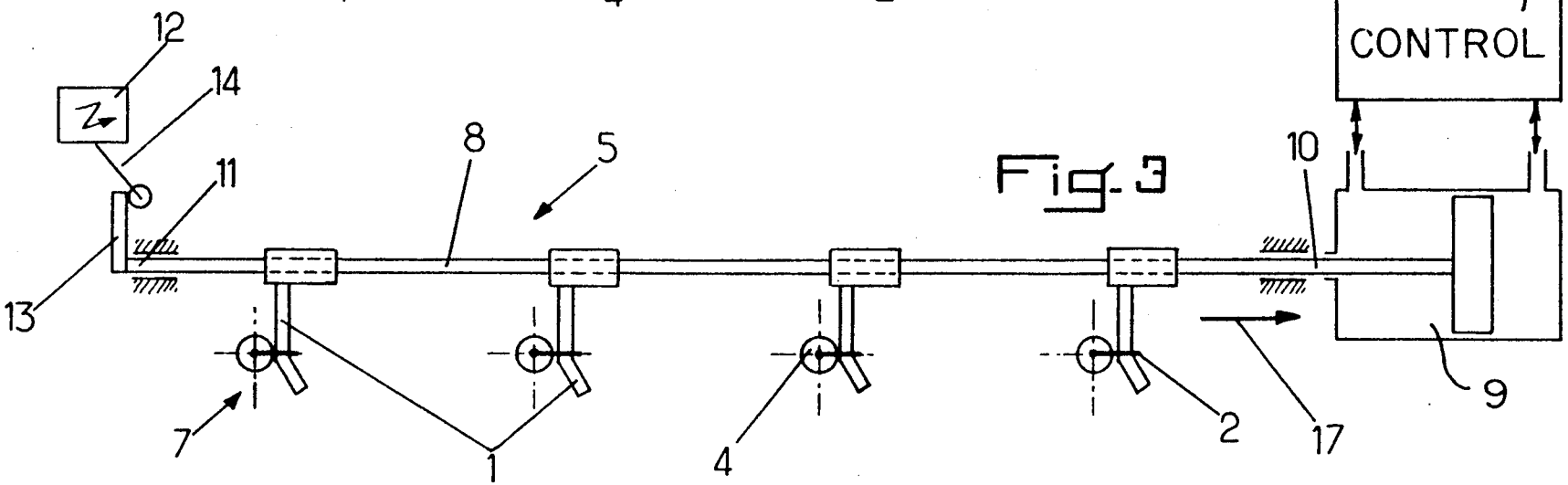
FIG. 3 is a plan view, on the same scale as FIG. 2, of the displacement means for said deflection members according to the invention during the three phases of acceleration, deceleration and stoppage of the machine.

According to a characteristic of the invention, and as shown in FIGS. 2 and 3, one 10 of the two extremities 10 and 11 of the connection device 8 is connected to the actuating means 9, and the other 11 is connected to the electronic monitor 12, of which a maintenance member 13 ensures electric contact 14 during the three phases of acceleration, deceleration and stoppage of the machine, so that this latter will not be operated unless the electric contact 14 is completed, this latter being released when the machine turns normally.

The maintenance member 13 could be, for example, an abutment.

As shown in FIGS. 2 and 3, the connecting device 8 could be in the form of a rod connected at its end 10 to a jack 9, so as to be adapted to reciprocate in translation. Fluid under pressure is supplied to one side or the other of jack 9 by a control 9*a* which senses acceleration, deceleration, stoppage and normal operation of the machine and supplies fluid under pressure to the right end of jack 9 in the last instance and to the left end in the first three instances.

The deflecting members 1 could be, for example, in the form of a hook 1 disposed adjacent the twisting device 3 of the thread 2 (FIGS. 2 and 3) or else in the form of at least one cylinder disposed adjacent said twisting device 3 of the thread 2 (FIG. 1).

Thus, during normal operation of the machine, that is to say during production of the wound threads 2, each thread passes through the "rotafil" 3 and is drawn and rolled up by the cylinders 15. Thus, during normal operation of the machine, the rod 8 is in the position shown in FIG. 2, which is to say that the hooks 1 are spaced from each wound thread 2 which, passing through the "rotafil" 3, will thus not touch the internal surface 16 of said "rotafil" 3, which ensures that it will have no influence on the wound thread 2.

By contrast, during the three phases of acceleration, deceleration and stoppage of the machine, the wound thread 2 is applied against the internal surface 16 of the "rotafil" 3, more particularly by means of the hooks 1. Thus during these three phases, the rod 8 is moved by the jack 9 in the direction of the arrow 17 and is again located in the position shown in FIG. 3.

Thus the hooks 1 are in a position such that they deflect the wound threads 2 which, for this reason, will again be applied against the internal surface 16 of the "rotafil" 3 so as to receive the false tension which imparts to them at that moment the desired constant tension and winding. Then, when the machine returns to normal operation, the jack 9 retracts the rod 8, in the direction of arrow 18 to the position shown in FIG. 2, which is to say that in which the wound thread 2 is no longer in contact with the "rotafil" 3.

The length of the path of movement of the deflecting members 1 could be, for example, between 10 and 40 mm, preferably 20 mm.

To control the operation of the assembly, the electronic monitor 12 mounted at the end of the rod 8, through the abutment 13, maintains the electric contact 14 during the three phases of acceleration, deceleration and stoppage of the machine, such that this latter cannot be operated except when the electric contact 14 is made. Of course, when the machine turns normally, the electric contact 14 is released.

According to a second embodiment of the invention, each displacement means 5 is directly connected to each deflecting member 1.

According to a supplemental feature of the invention, the displacement means 5 are each in the form of an actuating means 9, this latter being for example in the form of a jack connected to the electronic monitor 12.

Thus, in this embodiment, there are no connecting members 8 between said deflecting members 1. These latter are individually actuated, each for example by a jack 9.

Figure 4:
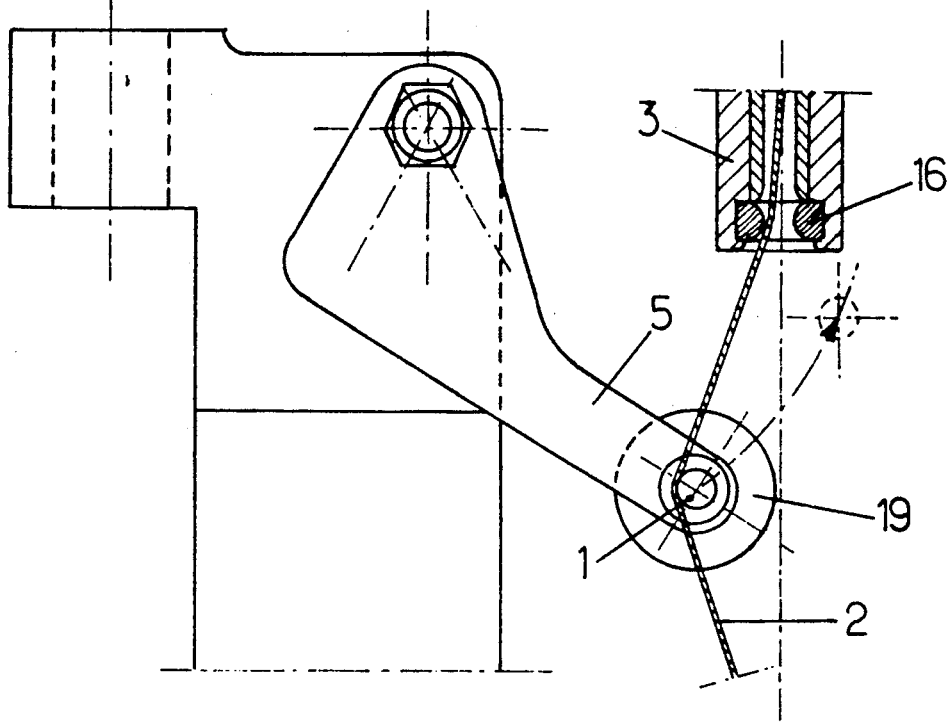
FIG. 4 is an elevational view, on a different scale, of displacement means in the form of a lever, for a deflection member in the form of a cylinder, according to the invention, during the three phases of acceleration, deceleration and stoppage of the machine.
Figure 5:
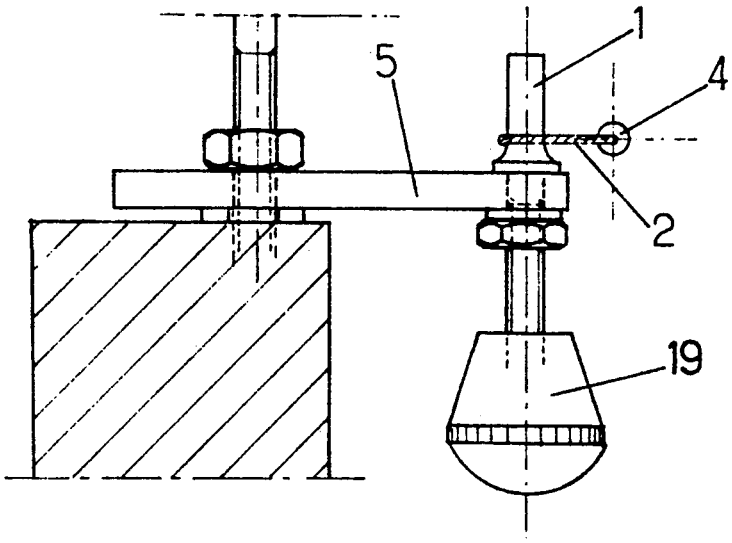
FIG. 5 is a plan view of the displacement means shown in FIG. 4.

The displacement means 5 can also be directly in the form, for example, each of a lever being adapted to be individually and manually operated by a handle 19. (FIGS. 4 and 5).

Such a modification is used when it is necessary to provide a so-called American connection. Thus, when the machine operates normally, the thread 2 is not in contact with the deflecting member 1, nor with the twisting device 3. During the phases of acceleration, deceleration and stoppage of the machine, each lever 5 is lowered and the deflecting member 1 which is fixed causes a deflection of the thread 2 which is thus placed in contact with the rotafil 16.

The levers 5 could be raised or lowered simultaneously or, and this is the point of the present modification, could be individually manipulated by the handle 19.

Of course, the invention is not limited to the embodiments described and shown in the accompanying drawings. Modifications remain possible, particularly as to the construction of the various members or by substitution of technical equivalents, without thereby departing from the scope of protection of the invention.

What is claimed is:

1. In a hollow spindle machine of the winding type having a twisting device (3) for thread (2) from a spindle to twist the thread on itself; the improvement comprising a deflection member (1) for deflecting the thread against the twisting device (3), displacement means (5) for displacing said deflection member (1) from a first position (6), during normal operation of the machine, in which the thread (2) is out of contact with the deflection member (1) and out of contact with the twisting device (3), to a second position (7) only during the phases of acceleration, deceleration and stoppage of the machine, in which second position (7) the thread (2) is applied by the deflection member (1) with which it is in contact against the twisting device (3), so as to impart to the thread (2) during only the phases of acceleration, deceleration and stoppage of the machine the false tension necessary to ensure to the thread during those phases constant tension and winding independently of the speed of thread travel, and control means responsive to acceleration, deceleration, stoppage and normal operation of the machine to actuate said displacement means (5).

2. A machine as claimed in claim 1, and an electronic monitor (12) that signals malfunction of the machine if the deflection member (1) deflects the thread into contact with the twisting device (3) during normal operation of the machine.

3. A machine as claimed in claim 2, in which said electronic monitor (12) shuts off the machine upon said malfunction.

4. A machine as claimed in claim 1, there being a plurality of said threads (2) associated with a plurality of said twisting devices (3) and a plurality of said deflection members (1), and a connecting device (8) interconnecting all said deflection members (1).

5. A machine as claimed in claim 4, and actuating means (9) in the form of a fluid motor having a cylinder and a piston and a piston rod (10) connected to the piston and extending from the cylinder to move said connecting device (8).

6. A machine as claimed in claim 5, said connecting device (8) being an elongated member, means slidably supporting said elongated member at opposite ends thereof, said plural deflection members (1) being spaced apart along said elongated member.

7. A machine as claimed in claim 6, and a maintaining member (13) at an end of said elongated member remote from said actuating means (9), and an electric contact (14) which is actuated by said maintaining member (13) only during said phases of acceleration, deceleration and stoppage of the machine, said electric contact (14) actuating an electronic monitor (12) adapted to discontinue operation of the machine if said maintaining member (13) contacts said electric contact (14) during normal running of the machine.

* * * * *